US005813758A

United States Patent [19]

Delcourt et al.

[11] Patent Number: 5,813,758

[45] Date of Patent: Sep. 29, 1998

[54] CONCENTRIC RING FLUIDIZING MIXER

[75] Inventors: Thomas R. Delcourt, Queensbury, N.Y.; Johan Gullichsen, Siuntio, Finland; Ronald G. Bain, S. Glens Falls; C. Bertil Stromberg, Glens Falls, both of N.Y.

[73] Assignee: Ahlstrom Machinery Inc., Glens Falls, N.Y.

[21] Appl. No.: 164,889

[22] Filed: Dec. 10, 1993

[51] Int. Cl.[6] ..... B01F 5/04

[52] U.S. Cl. ..... 366/171.1; 366/172.1; 366/172.2; 366/304; 366/305; 162/243; 416/223 B

[58] Field of Search ..... 366/167, 168, 366/171, 172, 303–305, 262–265, 176, 307; 162/57, 243; 416/188, 223 B

[56] References Cited

U.S. PATENT DOCUMENTS

| | | | |
|---|---|---|---|
| 2,645,464 | 7/1953 | Forbes | 366/304 |
| 2,969,960 | 1/1961 | Gurley, Jr. | 366/303 |
| 3,703,435 | 11/1972 | Schleinofer . | |
| 3,907,456 | 9/1975 | Krienke . | |
| 4,067,553 | 1/1978 | Yamaoka . | |
| 4,339,206 | 7/1982 | Ahs . | |
| 4,362,536 | 12/1982 | Gullichsen | 162/57 X |
| 4,410,337 | 10/1983 | Gullichsen et al. . | |
| 4,416,548 | 11/1983 | Carre et al. . | |
| 4,435,122 | 3/1984 | Nishanen et al. . | |
| 4,435,193 | 3/1984 | Gullichsen et al. . | |
| 4,577,974 | 3/1986 | Prough et al. . | |
| 4,675,033 | 6/1987 | Fellman et al. . | |
| 4,780,053 | 10/1988 | Gullichsen . | |
| 4,820,381 | 4/1989 | Brown | 162/57 X |
| 4,834,547 | 5/1989 | Niskanen | 366/165 |
| 4,854,819 | 8/1989 | Gullichsen . | |
| 4,877,368 | 10/1989 | Timperi et al. | 366/156 X |
| 5,209,641 | 5/1993 | Hoglund et al. | 416/223 B |
| 5,263,774 | 11/1993 | Delcourt | 366/171 X |

FOREIGN PATENT DOCUMENTS

| | | |
|---|---|---|
| 1102604 | 6/1981 | Canada . |
| 0 557 832 A1 | 9/1993 | European Pat. Off. . |
| 2 013 117 | 3/1970 | France . |
| 587803 | 5/1947 | United Kingdom . |
| WO 87/06496 | 11/1987 | WIPO . |

OTHER PUBLICATIONS

Soviet Inventions Illustrated, Section Ch, Week 8622, 13 Jun. 1986, Derwent Publications Ltd., London, GB & SU A, 191 102, 15 Nov. 1985; English Abstract.

International Technolgy Disclosures, vol. 1, No. 9, Jul. 25, 1983, #078305, Kamyr AB "Mixing Steam and/or Chemicals into a Fiber Suspension".

*Primary Examiner*—Charles E. Cooley

[57] ABSTRACT

A mixer, having a unique rotor, is particularly suitable for mixing paper pulp having a consistency of about 6–15% (medium consistency) with a bleaching gas having an ozone content of at least one percent, and typically at least six percent. The rotor comprises a disc shaped base, a hub at the center of the base for connecting it to a drive mechanism for driving the rotor at an angular velocity of 1000–6000 rpm, and one or more rings concentric with the base and extending outwardly from the base at least about three inches (and of the same for different heights). A number of blades may extend radially through the center of the base along the contour of the rings, extending outwardly from the base, rings, and hub. Degassing holes may be formed in the hub and connected up to a suitable degassing structure in the mixer. The rings may have a cross-sectional shape corresponding to that of a truncated right circular cone frustum, or may have a rectangular cross-section. The rotor is mounted in a housing having a pulp inlet and outlet, and the stator has complimentary shaped cooperating surfaces with the rotor defining annular mixing volumes, the cooperating surfaces having a spacing of 0.5 inches or less (preferably 0.25 inches or less). The fluid to be mixed with the pulp is introduced into the inlet adjacent the rotor and into the mixing volumes, for example at the extremity of the rings from the base.

16 Claims, 5 Drawing Sheets

CONCENTRIC RING FLUIDIZING MIXER

BACKGROUND AND SUMMARY OF THE INVENTION

In the art of bleaching cellulose pulp (paper pulp) it has long been recognized that the efficiency with which the bleaching chemicals are mixed with the pulp is critical to the economics of the bleaching process, and the quality of the bleached pulp produced. The more expensive the bleaching chemical, and the more expensive the cost of energy required to mix the chemicals with the pulp, the more important efficient mixing becomes. There have been numerous prior art mixers that have been effective for mixing bleaching chemicals, even gaseous bleaching chemicals such as chlorine dioxide and oxygen, with medium consistency pulp by fluidizing the pulp, shearing the fiber to fiber network such that the pulp behavior approaches that of a Newtonian fluid. The use of fluidization for mixing is, for example, described in Gullichsen Canadian patent 1,102,604.

While prior art designs have proved effective when mixing chlorine, chlorine dioxide, peroxide, sodium hydroxide, oxygen, and other commercially used bleaching chemicals in medium consistency pulp, they have not proven to be as effective when mixing a highly reactive bleaching chemical, such as ozone gas. Ozone reacts extremely rapidly with cellulose and non-cellulose components of unbleached pulp, typical reaction times being less than a second. This rapid reaction rate requires intimate contact between the gas and the individual fibers. While prior art mixers typically are characterized by direct contact of the chemical with the fiber and also by diffusion of the chemical through surrounding fiber bundles or flocks, the relatively longer reaction times exhibited by conventional bleaching chemicals accommodating such diffusion, the reactivity of the ozone gas requires less diffusion and more direct gas-fiber contact. Furthermore, due to the reactivity of ozone it is critical to distribute the ozone as uniformly as possible, the uniform distribution permitting the gas not only to react with each individual fiber, but also preventing localized high ozone concentrations which may cause damage to the fibers.

According to the present invention, a mixer, method of mixing ozone bleaching chemical with medium consistency pulp, and a rotor suitable for the mixer, are provided which provide excellent rate of delivering energy (power) to effect fluidization and disruption of fiber flocks so as to maximize the direct gas to fiber contact. While the mixer and rotor are particularly suitable for mixing the ozone gas, of course they are also suitable for mixing a wide variety of other bleaching chemicals, the mixer in general being an efficient mixer, distributing power over a small volume. The fluidizing rotor according to the invention has a relatively small diameter, also meaning that there is a smaller volume over which the power can be distributed; however at the same time this small volume must provide means for fluidizing the pulp.

The construction of the rotor according to the present invention, particularly cooperating with a stator disposed within a housing for the mixer with which it is associated, creates a power-intensive, low volume region of high intensity pulp mixing. This allows the rotor to be driven by a conventional power source, such as a direct drive motor rotating at 1000–6000 rpm.

According to the invention, relatively small clearances are also provided between the rotor and the stator. When mixing conventional chemicals with pulp this clearance is not as critical as when mixing gaseous ozone. Again, because the reactivity of the ozone, exposure of individual fibers to the ozone gas is necessary, requiring the shearing of fiber flocks so that the individual fibers are exposed. The closer the blades of the rotor to the stator, the greater the potential to disrupt the fiber flocks and expose individual fibers. The recommended clearance according to the present invention is 0.5 inches or less, while the preferred clearance is 0.25 inches or less.

According to one aspect of the present invention a rotor is provided comprising the following elements: A substantially disc-shaped base having a center about which the rotor can rotate, and a diameter. A hub at the center of the base for connecting the base to a drive mechanism. And, a first ring substantially concentric with the base and extending outwardly from the base at least about three inches.

Preferably a plurality of blades extend radially through the center and along the contour of the ring, extending outwardly from the base and the ring, and the blades also typically extend along the hub. For example four blades spaced evenly circumferentially around the base of the ring, each extending about 0.5 inches from the base and ring, may be provided. A second ring concentric with the first ring and extending outwardly from the base at least about three inches also may be provided, as may other rings if necessary, although it is desirable that the diameter of the base be relatively small (e.g. about 24 inches), which limits the space available for more than about two rings. The rings may have a cross-sectional shape corresponding to that of a truncated right circular cone frustum (e.g. with an angle of about 10°), or it may have a rectangular cross-sectional shape.

According to another aspect of the present invention a mixer is provided comprising: A housing having an inlet for pulp and an outlet. A rotor and a stator disposed in the housing, and having complimentary shaped cooperating surfaces spaced to define annular mixing volumes. A rotary drive mechanism having a drive shaft, for rotating the drive shaft at a speed of at least 1000 rpm (e.g. at least 2000 rpm). The rotor connected to the drive mechanism drive shaft, the drive mechanism rotating the rotor about an axis of rotation. And, means for mounting the stator with respect to the rotor so that the spacing between the cooperating surfaces is 0.5 inches (preferably 0.25 inches) or less substantially throughout the annular mixing volumes.

The mixer also comprises means for introducing fluid to be mixed with the pulp adjacent the inlet into the mixing volume (fluidization zone), and into the mixing volume at locations spaced from the inlet. The inlet is typically (though not necessarily) perpendicular to the outlet, and either the inlet may be concentric with the axis of rotation, or the outlet may be concentric with the axis of rotation. The rotor preferably is as described above, and the means for introducing the fluid to be mixed into the mixing volume comprises means for introducing the fluid at multiple locations adjacent portions of the ring or rings most remote from the base. The mixer also preferably comprises degassing means for removing gas from adjacent the axis of rotation within the housing to the exterior of the housing, which degassing may be similar to that shown, with respect to pumps, in U.S. Pat. Nos. 4,410,337 and 4,435,193.

According to another aspect of the present invention, a method of mixing pulp having a consistency of about 6–15% with bleaching gas having an ozone content of at least one percent (typically at least 6%, and all the way up to the maximum amount of ozone that can be provided in the gas), using a mixer having a rotor and a stator with annular mixing volumes in the spacing between complimentary surfaces of the rotor and stator, an inlet to the mixing volumes, and an outlet from the mixing volumes, is provided. The method comprises the following steps: (a) Feeding pulp with a consistency of about 6–15% into the inlet. (b) Introducing a first charge of bleaching gas having an ozone content of at least 1% into the inlet immediately adjacent the mixing volumes. (c) Rotating the rotor about an axis of rotation at a velocity sufficient to fluidize the pulp, and forcing the pulp through the mixing volumes from the inlet to the outlet. (d) Providing a spacing between the rotor and stator throughout the mixing volumes of 0.5 inches or less (preferably 25 inches or less). And, (e) introducing further charges of bleaching gas having an ozone content of at least 1% into the mixing volumes between the inlet and the outlet.

Typically the rotor comprises a disc shaped base having a diameter and a center through which the axis of rotation of the rotor passes, and at least one ring substantially concentric with the base and extending outwardly from the base to an extremity a distance of at least about three inches; and wherein the stator has a shape complimentary with the rotor; and wherein step (e) is practiced by introducing one or more charges adjacent to the extremity of the ring. Step (c) is typically practiced to pass the pulp about 90° (although a wide variety of angular orientations are possible) from the inlet to the outlet, and step (a) is practiced to introduce the pulp along the axis of rotation of the rotor, or perpendicular to the axis of rotation of the rotor. Step (c) is practiced to rotate the rotor at an angular velocity of 1000–6000 rpm. There also is preferably the step of degassing during mixing by withdrawing gas that collects adjacent the rotor from the mixing volumes.

It is the primary object of the present invention to provide an easy to construct rotor that is efficient, in a mixer, in mixing bleaching chemicals with pulp, and a method of efficiently and effectively mixing medium consistency pulp with ozone bleaching gas. This and other objects of the invention will become clear from an inspection of the detailed description of the invention, and from the appended claims.

DETAILED DESCRIPTION OF THE DRAWINGS

Figure 1:
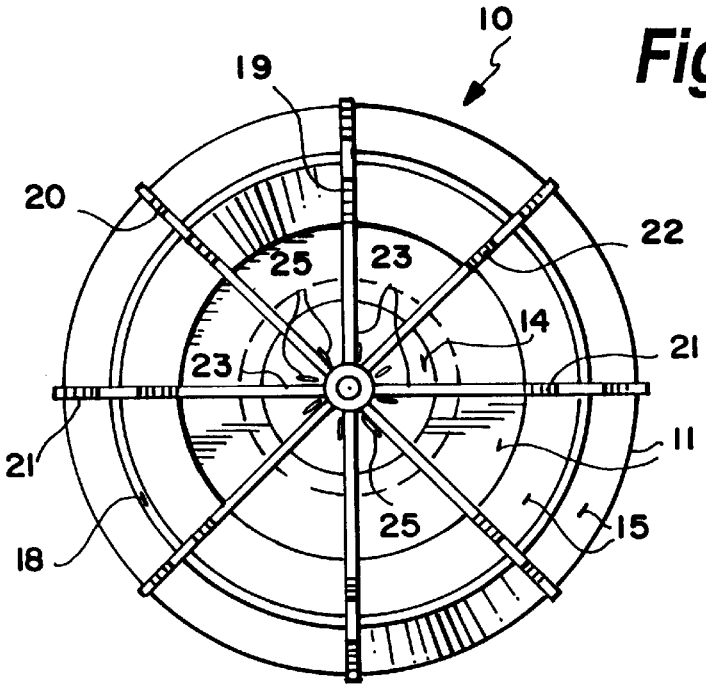
FIG. 1 is a top plan view of an exemplary rotor according to the present invention.
Figure 2:
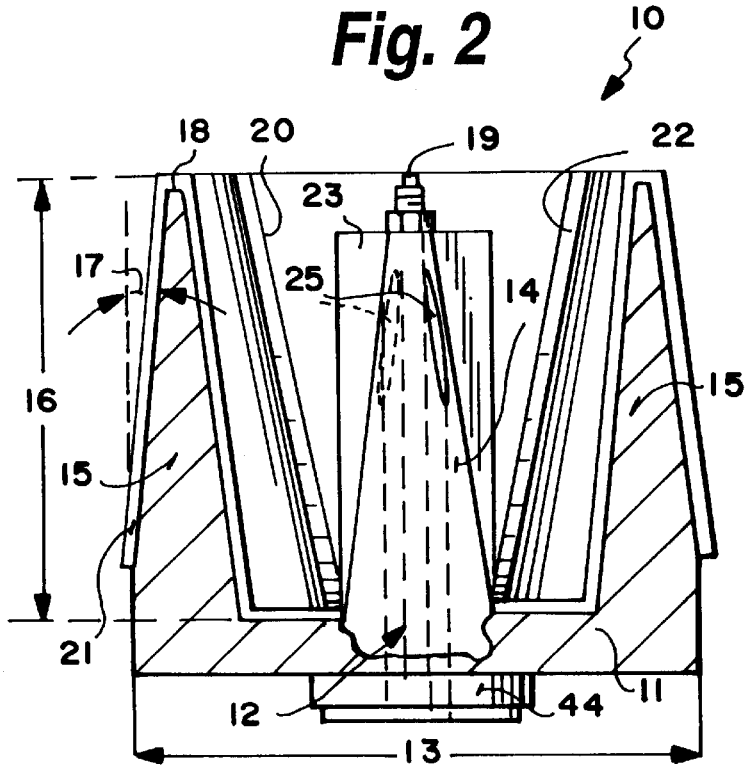
FIG. 2 is a side view, partly in cross-section and partly in elevation, of the rotor of FIG. 1.

FIGS. 1 and 2 illustrate a first embodiment of a rotor according to the present invention, shown generally by reference numeral 10. The rotor includes a substantially disc-shaped base 11 having a center 12 about which the rotor can rotate, and having a diameter 13. In order to provide maximum efficiency, for distributing power over as small a volume as possible, the diameter 13 of the rotor 10 is preferably small since the smaller the diameter the smaller the volume over which power can be distributed. For example, the diameter 13 may be about 24 inches. The rotor 10 also includes a hub 14 at the center 12 of the base 11 for connecting the base 11 to a drive mechanism, such as a conventional direct drive motor.

In order to effect fluidization of the pulp that the rotor 10 will be acting upon, the rotor 10 also comprises a first ring 15 substantially concentric with the base 11 and extending outwardly from the base a distance 16. The distance 16 is at least about three inches, depending upon the number of rings 15 provided, the properties of the pulp that will be acted upon, the exact chemical to be mixed with the pulp in the mixer utilizing the rotor 10, the diameter 13 of the disc 11, etc. For the particular rotor illustrated in FIGS. 1 and 2, where the cross-sectional shape of the ring 15 is a truncated right circular cone frustum (e.g. having an angle 17 of about 10°), the distance 16 may be about 13.5 inches where the base 13 diameter is about 24 inches. The ring 15 terminates in an annular extremity 18 (see FIG. 2).

As seen in FIGS. 1 and 2, the rotor 10 also preferably comprises a plurality of blades or ribs, which facilitate mixing, extending radially through the center 12 and along the contour of the ring 15, extending outwardly from the base 11 and the ring 15. In the embodiment illustrated in FIGS. 1 and 2, four such blades 19 through 22 are provided spaced evenly circumferentially around the base 11 and ring 15, and extending outwardly from the base 11 and ring 15 a distance sufficient to effect proper fluidization of the pulp when the rotor 10 is rotated. For example each of the blades 19 through 22 may extend outwardly from the base 11 or ring 15 a distance of about 0.5 inches, although that distance may be greater or lesser depending upon a wide variety of variables, and there may be even a differential in the height of a blade 19–22 between the base 11 and the ring 15, or even between opposite faces of the ring 15.

The rotor 10 may also comprise blades which are disposed on the hub 14, such as the blades 23 illustrated in FIGS. 1 and 2. Depending upon the exact configuration of the hub 14, the cooperating components of the mixer with which the rotor 10 is to be utilized, and other variables, the blades 23 may have a wide variety of shapes and amounts of protrusion from the hub 14. In the embodiment illustrated in FIG. 2, the blades 23 have a generally triangular shape.

Oftentimes in mixing pulp with gaseous bleaching chemicals gas tends to collect at the hub 14. In order to facilitate removal of this gas, and thereby enhance the efficiency of the mixer operation, a plurality of degassing holes 25 are provided in the hub 14, for example one hole 25 provided in each octant of the hub 14 defined by the blades 19 through 23, as seen in FIG. 1.

The hub 14 may have a wide variety of different configurations. For example in the FIG. 4 embodiment, the hub 14' has a much lesser height than the hub 14, and doesn't have blades 23 associated therewith. In the FIG. 5 embodiment, the hub 14" has blades 23' extending past the top thereof.

Figure 7:
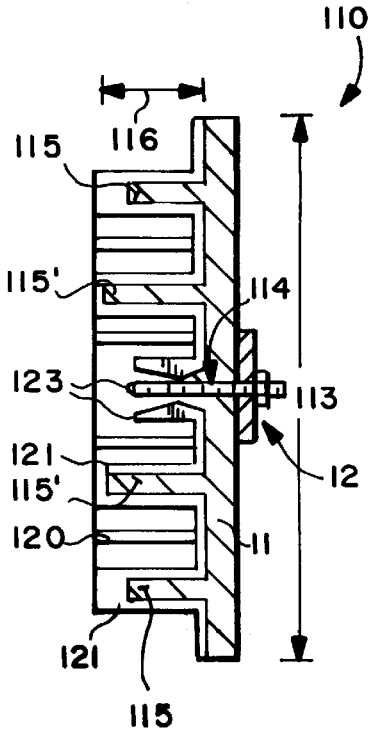
FIG. 7 is a side view, partly in cross-section and partly in elevation, of another embodiment of the rotor according to the present invention.
Figure 8:
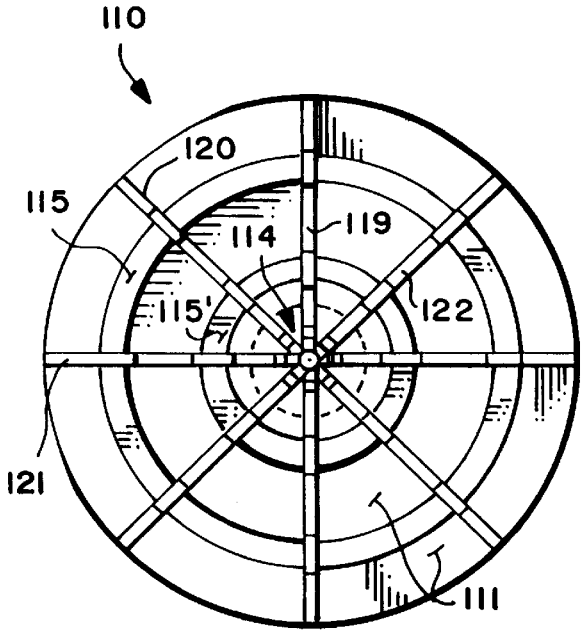
FIG. 8 is a top plan view of the rotor of FIG. 7.

FIGS. 7 and 8 show a different configuration of a rotor according to the present invention. In the FIGS. 7 and 8 embodiment components comparable to those in the FIGS. 1 and 2 embodiment are shown by the same reference numeral only preceded by a "1". Major distinctions between the FIGS. 7 and 8 embodiment and the FIGS. 1and 2 embodiment are in the number and configuration of the rings. In the FIGS. 7 and 8 embodiment first and second rings 115, 115' are provided, the rings 115, 115' each having a generally rectangular cross-section as clearly seen in FIG. 7, and the heights of different rings can be different, and if three or more rings are provided the heights may increase or decrease linearly or variably. Because two rings 115, 115' are provided, the height 116, 116' of each ring may be less than for the FIGS. 1and 2 embodiment. E.g. the heights 116, 116 ' shown in FIGS. 7 and 8 of the rings 115, 115' are about four inches and five inches if the diameter 113 is about 24 inches. In this embodiment the blades 119"122 follow the contour of both rings 115, 115'.

Figure 3:
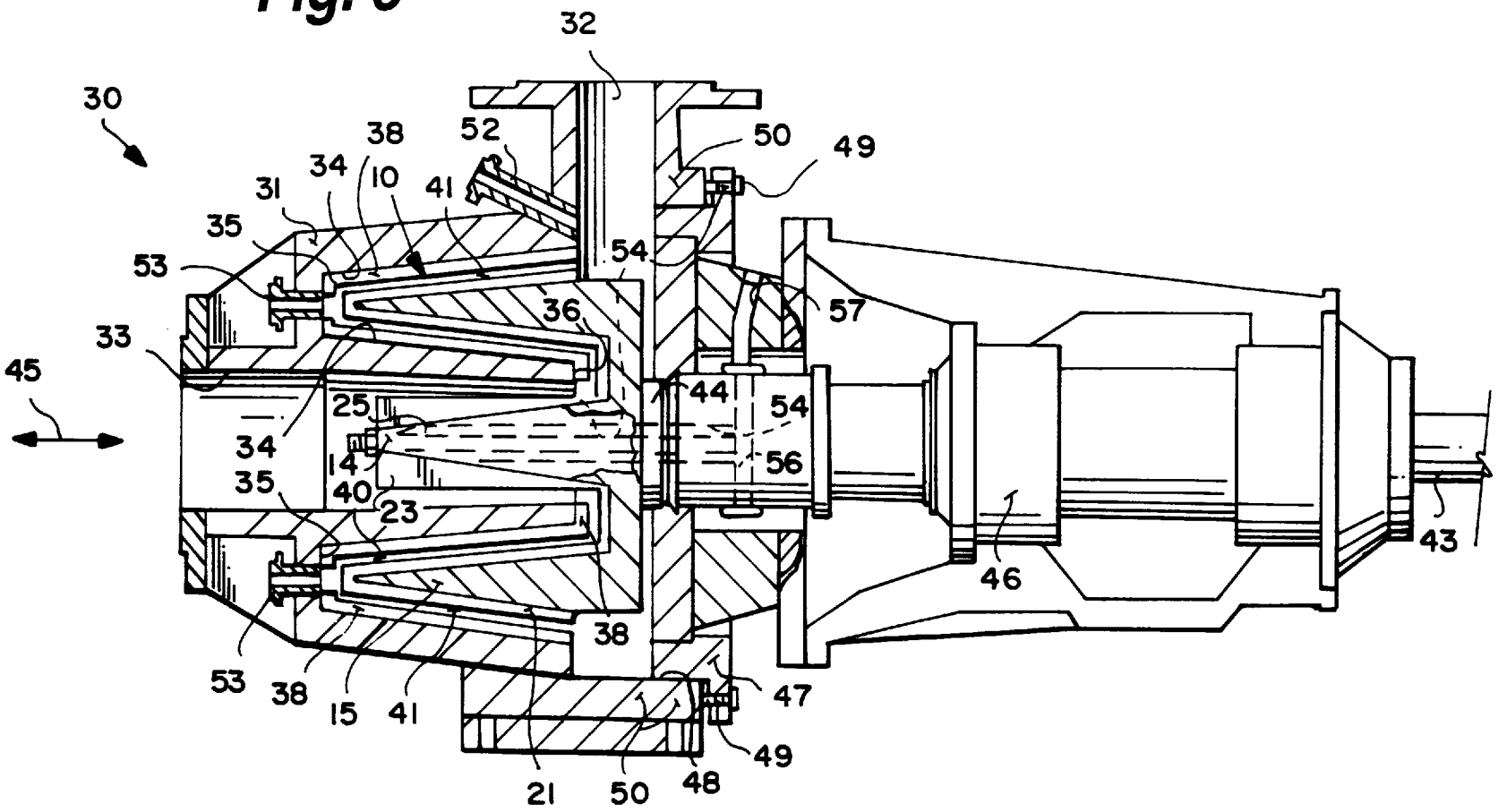
FIG. 3 is a side view, partly in cross-section and partly in elevation, of the rotor of FIGS. 1 and 2 in combination with a mixer.

The invention also comprises a mixer, such as the mixer 30 illustrated in FIG. 3, which contains the rotor 10. The mixer 30 includes a housing 31 having a pulp inlet 32 and a pulp outlet 33, e.g. for medium consistency (about 6–15% solids) pulp. The housing 31 interior defines a stator having complimentary surfaces corresponding to the rotor 10. For example the surfaces 34 are complimentary in shape to the ring 15, the surfaces 35 are generally complimentary in shape to the extremity 18 of the ring 15, and the surface 36 is generally complimentary to the base 11 interior of the ring 15. The stator surfaces 34 through 36 also preferably have radially extending blades which cooperate with the blades 19 through 22, such as the blades 38 illustrated in FIG. 3. Any number of radially extending blades 38 may be provided, either the same number as the blades 19 through 22 for the rotor 10, or less or more blades, but at least two blades extending the entire diameter of the stator surfaces 34–36 are provided.

The rotor 10 and stator surfaces 34–36 define annular mixing volumes, shown by reference numerals 40 and 41 in FIG. 3, in which the pulp and mixing fluid flow, during mixing. The spacing between the components defining the annular mixing volumes 40, 41 —in the case of the embodiment illustrated in FIG. 3 the spacing between the blades 19–22 and the blades 38—is typically 0.5 inches or less, preferably 0.25 inches or less. This small spacing is particularly important when ozone gas is the fluid being mixed with the pulp in the mixer 30.

The mixer 30 further comprises a rotary drive mechanism, such as the shaft 43 connected up to a conventional power source, such as a direct drive motor, which may rotate the rotor 10 at speeds ranging from just above zero to 6000 rpm. Where the mixer 30 is used for mixing medium consistency pulp, the angular velocity is at least 1000 rpm, and typically about 1000–4000 rpm, up to 6000 rpm, sufficient to fluidize the pulp.

The spacing provided for the annular volumes 40, 41 may be adjusted by adjusting the position of the rotor 10 with respect to the stator surfaces 34–36. For example, as illustrated in FIG. 3, the rotor 10, which is connected by the bottom part 44 of the hub 14 to the shaft 43, is movable with respect to the housing 31 in the dimension 45. This is accomplished, for example, by providing the bearing housing 46, which surrounds the shaft 43, and is integral with the housing portion 47, connected to the housing 31 by a sealing annular interface 48. By screwing in or out a plurality of bolts 49 disposed around the circumference of the annular housing 47, there will be sliding along the interface 48 between the housing 47 and the annular portion 50 of stationary housing 31, allowing a small (less than an inch) adjustment of the position of the rotor 10 in the dimension 45 with respect to the stator surfaces 34–36.

As seen in FIG. 3, preferably the inlet 32 and the outlet 33 are disposed at about 90° with respect to each other. However, the orientations of the inlet and outlet may be at almost any angle to each other and/or the axis of rotation. Means are provided for introducing the bleaching fluid (typically gas) to be mixed with the pulp at a number of different positions between the inlet 32 and the outlet 33. In the embodiment illustrated in FIG. 3, a first means for introducing the bleaching fluid, in the form of one or more conduits or nozzles 52, preferably introduce the first charge of bleaching fluid adjacent the inlet 32 actually into the annular mixing volume 41, as seen in the drawings. Additional conduits or nipples 53 are provided for introducing a second or additional charges of bleaching fluid, the positions of the conduits or nozzles 53 illustrated in FIG. 3 being particularly desirable, being located between the surfaces 35, 18, at the extremity of the ring 15 from the base 11, and also introducing the fluid directly into the mixing volume.

The mixer of FIG. 3 also includes degassing means. Degassing is provided by the degassing holes 25 in the hub 14 which are connected to the hollow interior passage 54 of the hub 14, which is aligned with a hollow passage 55 in the housing 46, communicating with a header 56 which has a conduit 57 extending therefrom leading to the exterior of the mixer 30. If desired, a positive displacement component may be provided in the header 56 for facilitating passage of the gas out the conduit 57, such as blades extending from the shaft 43 at that point. Other suitable degassing arrangements of conventional design, such as shown in U.S. Pat. Nos. 4,410,337 and 4,435,193, may also be provided.

In the operation of the mixer of FIG. 3, medium consistency pulp enters the inlet 32 and is supplied with a charge of bleaching fluid, for example ozone containing gas (having at least one percent ozone, and typically more than 6% ozone, up to the maximum amount of ozone that can be provided in a carrier gas), the ozone being introduced immediately before the rotor 10. The rotor 10 is being rotated at an angular velocity of about 1000–6000 rpm by the shaft 43, and the pulp is then caused to pass to the left as illustrated in FIG. 3 through the annular mixing volume 41, where the pulp is fluidized and intimately mixed with the ozone containing gas. A second charge of ozone containing gas may be provided at multiple points between the volumes 41, 40, for example through the conduits 53, that gas and the pulp again being intimately mixed in the mixing volume 40, before the pulp passes toward the hub 14 and then out the outlet 33.

Figure 4:
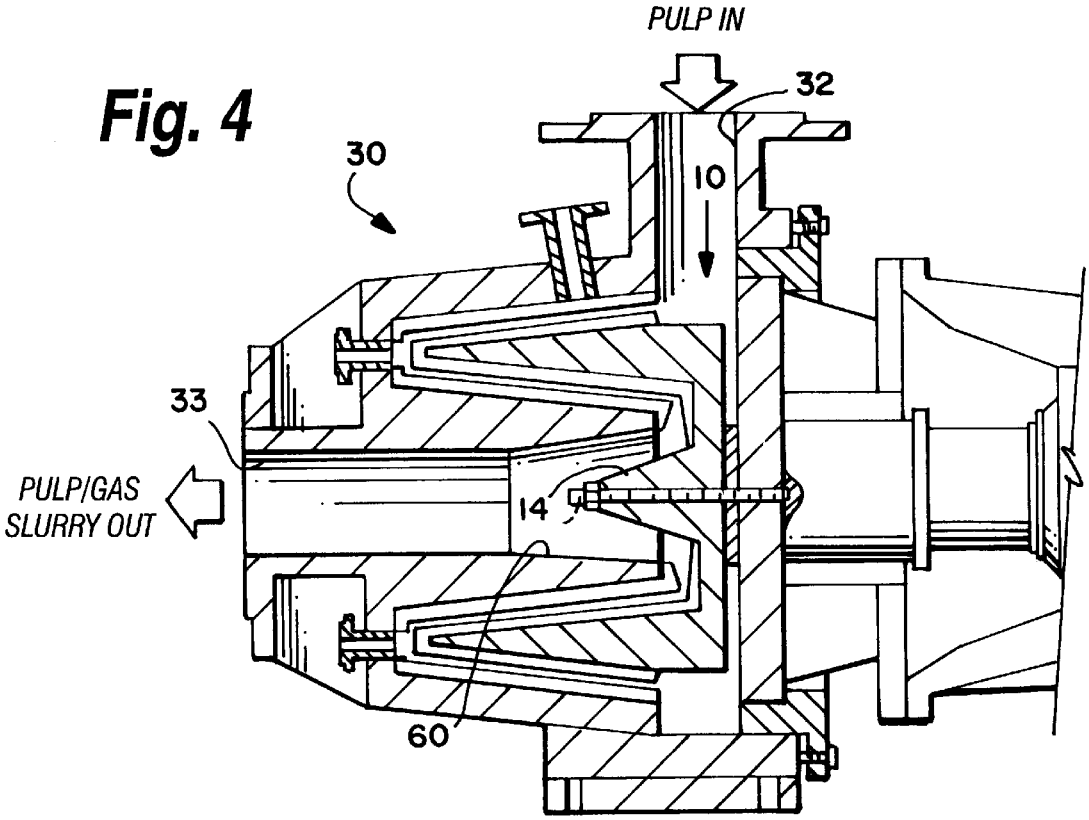
FIGS. 4 and 5 are views similar to that of FIG. 3 only showing different modifications of the mixer components, according to the present invention.

FIG. 4 shows a mixer 30 substantially identical to the mixer 30 of FIG. 3 except that the configuration of the hub 14' of the rotor 10 is different, as is the shape 60 of the outlet 33 immediately adjacent the hub 14', having the conical configuration illustrated in FIG. 4.

Figure 5:
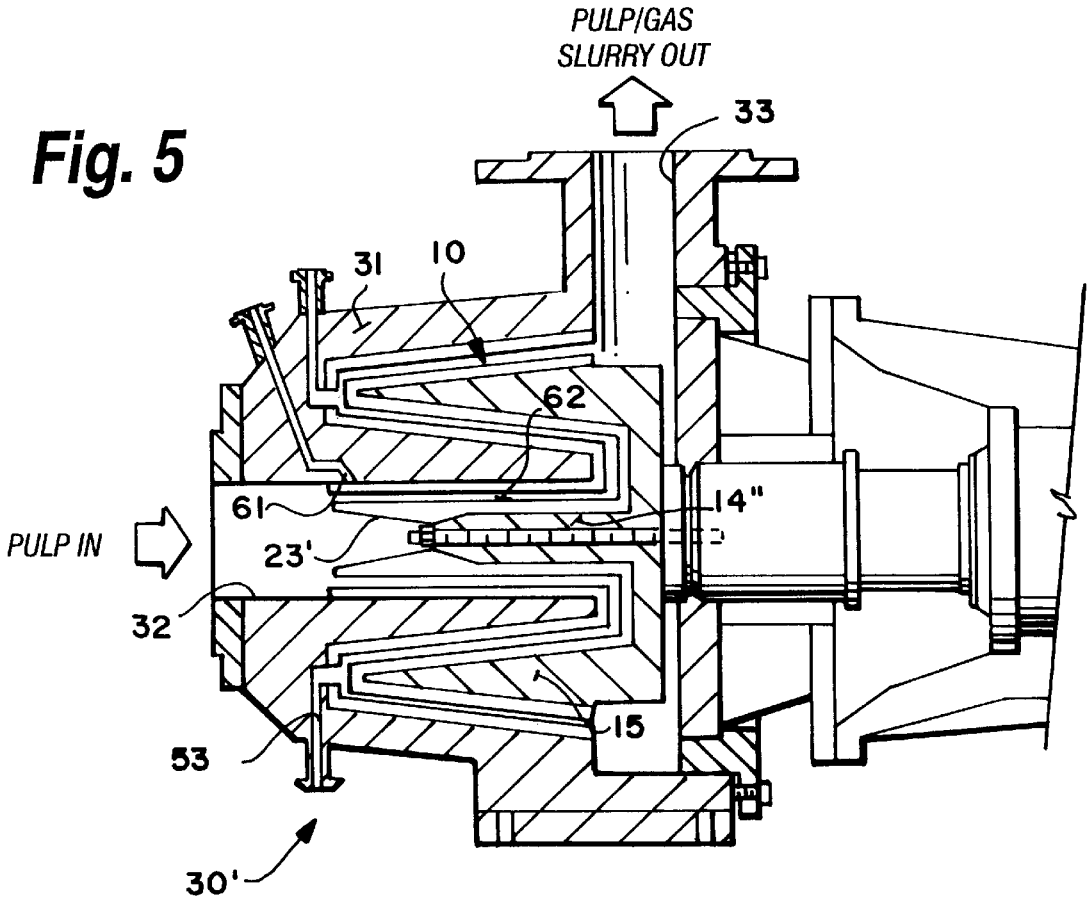

In FIG. 5, instead of the outlet 33 being concentric with the axis of rotation of the rotor, the inlet 32 is concentric with the axis of rotation, and the mixing chemical introduction conduit 61 is immediately upstream of the blades 23', the blades 23' rotating at 1000–6000 rpm immediately fluidizing the pulp at the area of mixing chemical addition. The annular mixing volume 62 provided in this embodiment has the same spacing between cooperating surfaces (e.g. less than 0.5 inches) as in the FIGS. 3 and 4 embodiment, the annular mixing volume 62 adding significantly to the total mixing volume of the mixer 30' of FIG. 5 compared to the mixer 30 of FIGS. 3 and 4. Other components of this embodiment of mixer are essentially identical to those of the FIGS. 3 and 4 embodiments and are shown by the same reference numerals.

Figure 6:
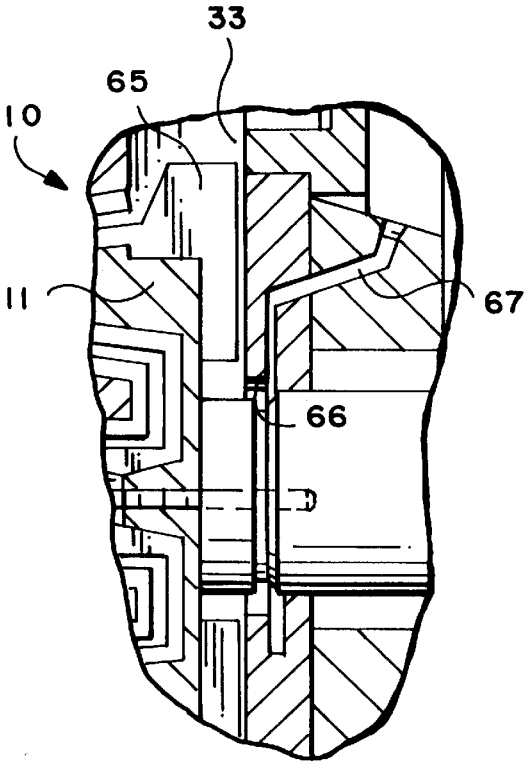
FIG. 6 is a detail view of the mixer of FIG. 3 showing degassing passages associated therewith.

FIG. 6 illustrates a modification of the degassing structure that may be provided. In this embodiment, which is otherwise the same as the FIG. 5 embodiment (that is with the inlet 32 concentric with the axis of rotation of the rotor 10), radial impellers 65 are provided on the disc 11 in the outlet 33, generating a centrifugal field so that gas is caused to collect at the axis of the rotor 10, and is then extracted through passageway 66 and port 67, which port 67 leads to the exterior of the mixer.

Figure 9:
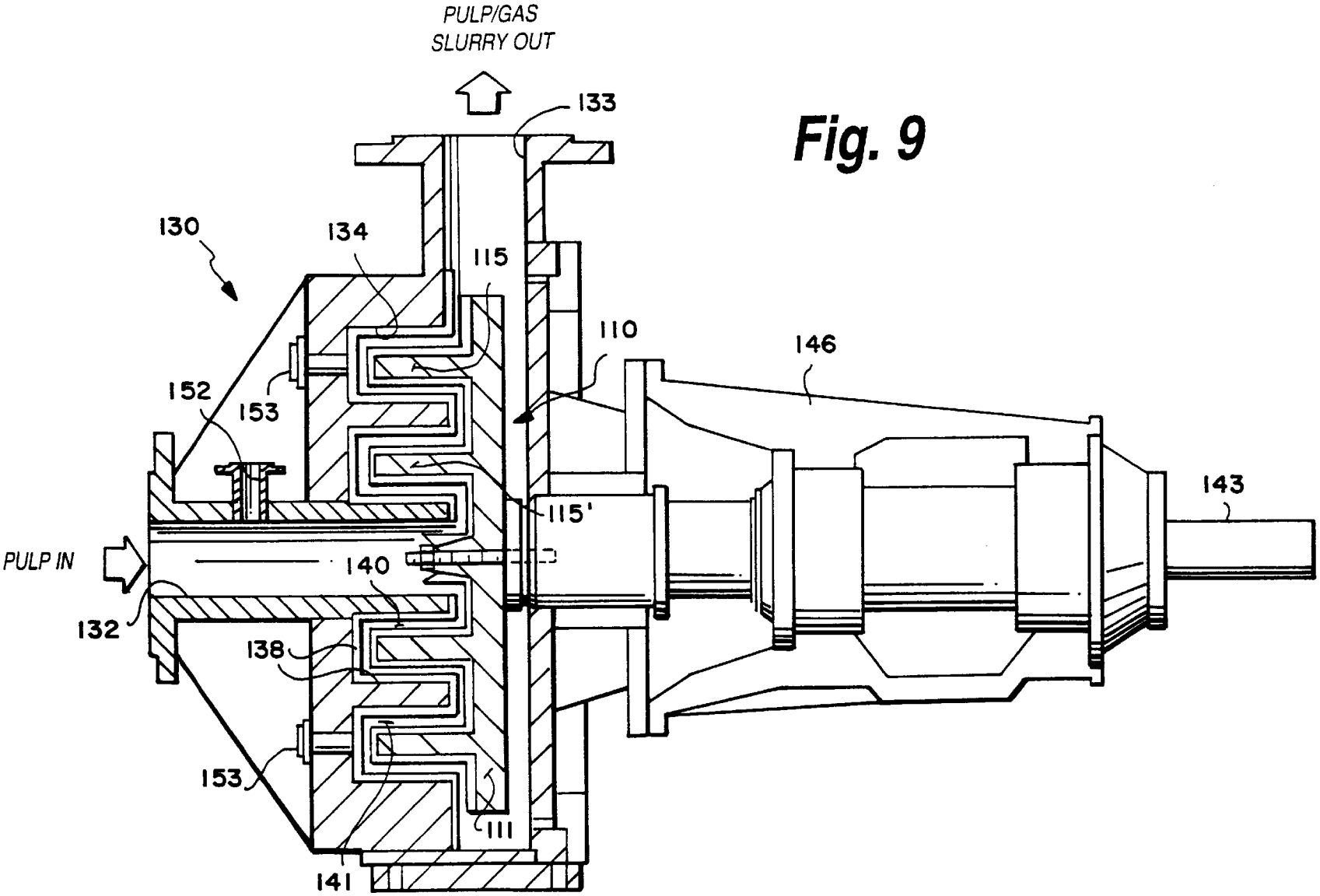
FIG. 9 is a view like that of FIG. 3 only showing a mixer having the rotor of FIGS. 7 and 8.

FIG. 9 illustrates a mixer 130 according to the present invention. The mixer 130 is like the mixer 30' except that it includes the rotor 110, and therefore the components thereof are modified accordingly. In the FIG. 9 embodiment components comparable to those in the FIGS. 3 through 5 embodiment are shown by the same reference numeral only preceded by a "1" and attention is directed to those embodiments for a description of the components, the operation of the components otherwise being the same. That is the pulp passing in the inlet 132 has ozone gas introduced through conduit 152, is fluidized by the rotating rotor 110, passes in the annular volumes 140, 141, with additional ozone introduced through conduits 153, and ultimately passes out the outlet 133, with the ozone having been intimately mixed with the pulp, and in view of the speed of the ozone reaction, often substantially the entire ozone bleaching reaction having taken place by the time the pulp is discharged from the outlet 133, or shortly thereafter. A rotary drive mechanism 70, including the drive shaft 143, is provided, the drive mechanism 70 rotating the drive shaft 143 at a speed of at least 1000 rpm.

It will thus be seen that according to the present invention a rotor, mixer, and method of mixing have been provided which provide for the efficient delivery of energy to the pulp to effectively mix the bleaching chemical with pulp, even mixing ozone bleaching gas with medium consistency pulp. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A mixer comprising:

a housing having an inlet for pulp and an outlet;

a rotor and a stator disposed in said housing, said rotor and stator having complimentary shaped cooperating surfaces spaced to define annular mixing volumes;

a rotary drive mechanism having a drive shaft, for rotating said drive shaft;

said rotor connected to said drive mechanism drive shaft, said drive mechanism rotating said rotor about an axis of rotation;

means for mounting said stator with respect to said rotor so that the spacing between said cooperating surfaces is 0.5 inches or less substantially throughout said annular mixing volumes;

said rotor comprising: a substantially disc-shaped base having a center about which said rotor can rotate, and a diameter; a hub at said center of said base for connecting said base to said rotary drive mechanism; a first ring substantially concentric with said base and extending outwardly from said base; a plurality of blades extending radially through said center and along the contour of said first ring, and said blades extending outwardly from said base and said ring; and wherein said stator has a plurality of radially extending blades complimentary to said rotor blades.

2. A mixer as recited in claim 1 wherein said means for mounting said stator with respect to said rotor comprises means for mounting said rotor and stator so that the spacing between said cooperating surfaces thereof is 0.25 inches or less substantially throughout said annular mixing volumes.

3. A mixer as recited in claim 1 further comprising means for introducing fluid to be mixed with pulp adjacent said inlet into one of said mixing volumes, and also into said mixing volumes remote from said inlet; and wherein said inlet is perpendicular to said outlet.

4. A mixer as recited in claim 3 wherein said inlet is concentric with said axis of rotation.

5. A mixer as recited in claim 3 wherein said outlet is concentric with said axis of rotation.

6. A mixer as recited in claim 1 further comprising means for introducing fluid to be mixed with pulp adjacent said inlet into one of said mixing volumes, and also into said mixing volumes remote from said inlet, said means for introducing fluid into said mixing volumes remote from said inlet comprising means for introducing fluid at multiple locations adjacent portions of said first ring most remote from said base.

7. A mixer as recited in claim 1 further comprising degassing means for removing gas from adjacent said axis of rotation within said housing to the exterior of said housing.

8. A mixer as recited in claim 1 wherein said first ring has a cross-sectional shape corresponding to that of a truncated right circular cone frustum.

9. A mixer as recited in claim 1 wherein said first ring has a rectangular cross-sectional shape.

10. A mixer as recited in claim 1 wherein said blades extend about 0.5 inches from said base and ring.

11. A mixer as recited in claim 1 further comprising a second ring concentric with said first ring and extending outwardly from said base at least about three inches.

12. A mixer as recited in claim 11 wherein said first ring extends outwardly from said base at least about three inches.

13. A mixer as recited in claim 11 further comprising means for introducing fluid to be mixed with pulp adjacent said inlet into one of said mixing volumes, and also into said mixing volumes remote from said inlet; and wherein said inlet is perpendicular to said outlet.

14. A mixer comprising:

a housing having an inlet for pulp and an outlet;

a rotor and a stator disposed in said housing, said stator and rotor having complimentary shaped cooperating surfaces spaced to define annular mixing volumes;

a rotary drive mechanism having a drive shaft, for rotating said drive shaft at a speed of at least 1000 rpm;

said rotor connected to said drive mechanism drive shaft, said drive mechanism rotating said rotor about an axis of rotation;

means for mounting said stator with respect to said rotor so that the spacing between said cooperating surfaces is 0.5 inches or less substantially throughout said annular mixing volumes; and said rotor comprising: a substantially disc-shaped base having a center about which said rotor can rotate, and a diameter; a hub at said center of said base for connecting said base to said rotary drive mechanism; and a first ring substantially concentric with said base and extending outwardly from said base at least about three inches, said first ring having a cross-sectional shape corresponding to that of a truncated right circular cone frustum.

15. A mixer as recited in claim 14 further comprising a second ring concentric with said first ring and extending outwardly from said base at least about three inches.

16. A mixer comprising:

a housing having an inlet for pulp and an outlet;

a rotor and a stator disposed in said housing, said stator and rotor having complimentary shaped cooperating surfaces spaced to define annular mixing volumes;

a rotary drive mechanism having a drive shaft, for rotating said drive shaft at a speed of at least 1000 rpm;

said rotor connected to said drive mechanism drive shaft, said drive mechanism rotating said rotor about an axis of rotation;

means for mounting said stator with respect to said rotor so that the spacing between said cooperating surfaces is 0.5 inches or less substantially throughout said annular mixing volumes;

said rotor comprising: a substantially disc-shaped base having a center about which said rotor can rotate, and a diameter; a hub at said center of said base for connecting said base to said rotary drive mechanism; and a first ring substantially concentric with said base and extending outwardly from said base, said first ring having a cross-sectional shape corresponding to that of a truncated right circular cone frustum; and a second ring concentric with said first ring and extending outwardly from said base at least about three inches.

* * * * *